US010788249B2

(12) United States Patent
Saito

(10) Patent No.: US 10,788,249 B2
(45) Date of Patent: Sep. 29, 2020

(54) ICE MAKING DEVICE

(71) Applicant: NIDEC SANKYO CORPORATION, Nagano (JP)

(72) Inventor: Shunji Saito, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 149 days.

(21) Appl. No.: 16/116,942

(22) Filed: Aug. 30, 2018

(65) Prior Publication Data

US 2019/0063813 A1 Feb. 28, 2019

(30) Foreign Application Priority Data

Aug. 31, 2017 (JP) ..... 2017-166788

(51) Int. Cl.
*F25C 1/10* (2006.01)
*F25D 23/06* (2006.01)
*F25C 5/06* (2006.01)

(52) U.S. Cl.
CPC ..... *F25C 1/10* (2013.01); *F25C 5/06* (2013.01); *F25D 23/067* (2013.01); *F25C 2305/022* (2013.01); *F25C 2700/12* (2013.01)

(58) Field of Classification Search
CPC ..... F25C 5/22; F25C 5/06; F25C 1/10; F25C 2700/12; F25C 2305/022; F25D 23/067
See application file for complete search history.

(56) References Cited

U.S. PATENT DOCUMENTS 10,030,902 B2 * 7/2018 Bauman ..... F25C 1/10
2008/0237000 A1 * 10/2008 Maehara ..... F25D 29/005 200/19.21
2010/0031679 A1 * 2/2010 Park ..... F25C 5/06 62/129
2010/0218524 A1 * 9/2010 Saito ..... F25D 23/12 62/135

(Continued)

FOREIGN PATENT DOCUMENTS

CA 2366254 2/2012
CN 1175678 3/1998

(Continued)

OTHER PUBLICATIONS

"Office Action of China Counterpart Application", dated Apr. 20, 2020, with English translation thereof, p. 1-p. 17.

*Primary Examiner* — Kun Kai Ma
(74) *Attorney, Agent, or Firm* — JCIPRNET

(57) ABSTRACT

An ice making device includes an ice tray, a drive unit structured to make the ice tray perform a reversing operation and a twisting operation interlocked with the reversing operation, and a frame on which the drive unit is mounted. The frame comprises, in a mounting part for the drive unit, a fitted part to which a connecting part of the drive unit is fitted when the drive unit has been moved from one side in to the other side, and a first coming-off prevention part structured to prevent coming-off of the connecting part from the fitted part. The first coming-off prevention part comprises a first arm part which is extended from the one side to the other side, and a first restriction part which is protruded from a tip end side of the first arm part and is capable of abutting with the drive unit from the one side.

14 Claims, 8 Drawing Sheets

(56) References Cited

U.S. PATENT DOCUMENTS

| | | | | |
|---|---|---|---|---|
| 2012/0240613 | A1* | 9/2012 | Saito | F25C 1/24 62/344 |
| 2013/0233010 | A1* | 9/2013 | Choi | F25C 1/00 62/340 |
| 2014/0360219 | A1* | 12/2014 | Lee | F25C 1/04 62/353 |
| 2015/0068224 | A1* | 3/2015 | Subera | F25C 5/187 62/66 |
| 2015/0345851 | A1* | 12/2015 | Ramirez, Jr. | H02K 11/33 62/72 |
| 2016/0116199 | A1* | 4/2016 | Fischer | F25C 5/185 62/344 |
| 2018/0372389 | A1* | 12/2018 | Jeong | F25D 29/005 |

FOREIGN PATENT DOCUMENTS

| | | |
|---|---|---|
| CN | 1746598 | 3/2006 |
| CN | 101598478 | 12/2009 |
| CN | 102549358 | 7/2012 |
| CN | 204063734 | 12/2014 |
| EP | 2910876 | 12/2015 |
| JP | 2011089758 | 5/2011 |

* cited by examiner

ICE MAKING DEVICE

CROSS REFERENCE TO RELATED APPLICATION

The present invention claims priority under 35 U.S.C. § 119 to Japanese Application No. 2017-166788 filed Aug. 31, 2017, the entire content of which is incorporated herein by reference.

TECHNICAL FIELD

The present invention relates to an ice making device in which a drive unit structured to drive an ice tray is mounted on a frame.

BACKGROUND

An ice making device which is mounted on a refrigerator includes an ice tray whose water storage recessed parts are disposed upward. The ice tray is performed with a reversing operation in which the ice tray is reversed around a horizontal axial line and a twisting operation interlocked with the reversing operation by a drive unit and thereby ice pieces are dropped to an ice storage container (see Patent Literature 1, Japanese Patent Laid-Open No. 2011-89758). In the ice making device, as schematically shown in FIG. 8A, a drive unit 3 (drive part) is mounted on a mounting part 40 of a frame (frame body). Therefore, the mounting part 40 includes fitted parts 47 (pawl insertion part) to which connecting parts 37 (pawl piece) of the drive unit 3 are fitted when the drive unit 3 has been moved from one side "Y1" to the other side "Y2", and a coming-off prevention part 48 (holding part) for preventing coming-off of the connecting parts 37 from the fitted parts 47 by abutting with the drive unit 3 from one side "Y1" in a moving direction when the drive unit 3 has been moved. In this case, the coming-off prevention part 48 is provided with an arm part 488 extended from the other side "Y2" to one side "Y1" and an abutting part 489 which is protruded in a direction intersecting the moving direction from a tip end side of the arm part 488 and is abutted with a side wall of the drive unit 3 from one side "Y1".

However, in the coming-off prevention part 48 shown in FIG. 8A, it is structured that the abutting part 489 provided on a tip end side of the arm part 488 extended from the other side "Y2" to one side "Y1" is abutted with the side wall of the drive unit 3 from one side "Y1". Therefore, when a force "F" directing to one side "Y1" is applied to the drive unit 3, as shown in FIG. 8B, the arm part 488 is easily resiliently bent in a direction that the abutting part 489 is disengaged from the drive unit 3. Accordingly, the connecting parts 37 are easily come off from the fitted parts 47.

SUMMARY

In view of the problem described above, an objective of the present invention is to provide an ice making device in which a connecting part of a drive unit is hard to be disengaged from a fitted part provided in a frame.

To achieve the above mentioned objective, the present invention provides an ice making device including an ice tray having water storage recessed parts disposed upward, a drive unit structured to make the ice tray perform a reversing operation around an axial line extended in a first direction intersecting an upper and lower direction and perform a twisting operation interlocked with the reversing operation, and a frame on which the drive unit is mounted. The frame is provided in a mounting part for the drive unit with a fitted part to which a connecting part of the drive unit is fitted when the drive unit has been moved from one side to the other side in a second direction intersecting the first direction, and a first coming-off prevention part structured to prevent coming-off of the connecting part from the fitted part when the drive unit has been moved from the one side to the other side in the second direction. The first coming-off prevention part is provided with a first arm part which is extended from the one side to the other side in the second direction, and a first restriction part which is protruded from a tip end side of the first arm part in a direction intersecting the second direction and is capable of abutting with the drive unit from the one side in the second direction.

In the present invention, when the drive unit has been moved from the one side to the other side in the second direction, the connecting part of the drive unit is fitted to the fitted part of the frame and thus the drive unit can be fixed to the mounting part of the frame. Further, coming-off of the connecting part from the fitted part can be prevented by the first coming-off prevention part of the frame. In this case, in the first coming-off prevention part, the first restriction part formed at a tip end side of the first arm part extended from the one side to the other side in the second direction is capable of abutting with the drive unit from the one side in the second direction. Therefore, even in a case that a force is applied to the drive unit toward the one side in the second direction, the first arm part is hard to be resiliently bent in a direction that the first restriction part is disengaged from the drive unit. Accordingly, the connecting part provided in the drive unit is hard to be disengaged from the fitted part provided in the frame. Specifically, it may be structured that the drive unit includes a cam gear which is turned by a rotating force of a motor on an inner side of a case, the cam gear is provided with an output shaft which is protruded from the case and is connected with the ice tray, the connecting part of the drive unit is formed so as to be protruded from the case in the first direction and fitted to the fitted part and is capable of abutting with the first restriction part of the first coming-off prevention part.

In the present invention, it may be structured that the mounting part is provided with a support face which supports the drive unit from one side in a third direction intersecting the first direction and the second direction in a state that the connecting part is fitted to the fitted part, and the first coming-off prevention part is structured so that the first arm part is extended along the support face and the first restriction part is protruded from a tip end side of the first arm part toward the other side in the third direction. According to this structure, when the drive unit is to be mounted on the mounting part of the frame, the first restriction part is pressed by the drive unit and the first arm part is resiliently deformed and thus the drive unit can be easily mounted on the mounting part of the frame. In this case, it may be structured that the mounting part is provided with a support face which supports the drive unit from one side in a third direction intersecting the first direction and the second direction in a state that the connecting part is fitted to the fitted part, the first coming-off prevention part is provided in the frame on the other side in the first direction with respect to an end plate of the case from which the output shaft is protruded, the first coming-off prevention part is structured so that the first arm part is extended along the support face and the first restriction part is protruded from a tip end side of the first arm part toward the other side in the third direction, and the connecting part is formed so as to be protruded from the end plate of the case to the other side in the first direction and is capable of abutting with the first restriction part.

In the present invention, it may be structured that the fitted part is provided with a first pawl which is protruded toward the other side in the third direction and whose tip end side is bent to the one side in the second direction, and the drive unit includes, as the connecting part, a first plate part whose plate thickness direction is directed in the third direction and which is protruded from the one side to the other side in the first direction and is fitted to an inner side of the first pawl.

In the present invention, it may be structured that the first restriction part is capable of abutting with the first plate part from the one side in the second direction. According to this structure, the first coming-off prevention part prevents coming-off of the first plate part which is fitted to the first pawl and thus the first plate part is hard to be disengaged from the first pawl.

In the present invention, it may be structured that the first plate part is provided with an inclined part which is inclined so that plate thickness of the first plate part is reduced from the one side toward the other side in the first direction. According to this structure, when the first plate part is to be fitted to an inner side of the first pawl, the first plate part is easily fitted to an inner side of the first pawl from an end part on the other side in the first direction whose plate thickness is reduced.

In the present invention, it may be structured that the fitted part includes a second pawl which is protruded toward the other side in the third direction and whose tip end side is bent to the one side in the second direction at a position separated from the first pawl to the other side in the second direction, and the drive unit includes, as the connecting part, a second plate part whose plate thickness direction is directed in the third direction and which is protruded from the one side, for example, from an end plate of the case, to the other side in the first direction and is fitted to an inner side of the second pawl at a position separated from the first plate part to the other side in the second direction. According to this structure, the first plate part and the second plate part are respectively fitted to the first pawl and the second pawl and thus the drive unit can be fixed to the frame surely.

In the present invention, it may be structured that the second plate part is provided with an inclined part which is inclined so that plate thickness of the second plate part is reduced from the one side toward the other side in the first direction. According to this structure, when the second plate part is to be fitted to an inner side of the second pawl, the second plate part is easily fitted to an inner side of the second pawl from an end part on the other side in the first direction whose plate thickness is reduced.

In the present invention, it may be structured that the support face is an imaginary face determined by reinforcing ribs which are formed in a portion of the mounting part overlapped with the drive unit. According to this structure, strength of the mounting part can be increased.

In the present invention, it may be structured that the mounting part is provided with a second coming-off prevention part which is provided at a position separated from the first coming-off prevention parting in the first direction and is capable of abutting with the drive unit from the one side in the second direction and prevents coming-off of the connecting part from the fitted part when the drive unit has been moved from the one side to the other side in the second direction, and the second coming-off prevention part is provided with a second arm part which is extended from the other side to the one side in the second direction, and a second restriction part which is protruded from a tip end side of the second arm part in a direction intersecting the second direction and is capable of abutting with the drive unit from the one side in the second direction. Specifically, it may be structured that the frame includes a first side plate part which is extended in the first direction on the other side in the second direction, and a second side plate part which is extended in the first direction on the one side in the second direction so as to be parallel to the first side plate part, and the mounting part for the drive unit is formed between the first side plate part and the second side plate part, and the case is formed in a substantially rectangular parallelepiped shape. The mounting part is provided with a second coming-off prevention part which is provided at a position separated from the first coming-off prevention part in the first direction and is capable of abutting with the case from the one side in the second direction to prevent coming-off of the connecting part from the fitted part when the drive unit has been moved from the one side to the other side in the second direction. The second coming-off prevention part is provided with a second arm part which is extended from the other side to the one side in the second direction, and a second restriction part which is protruded from a tip end side of the second arm part in a direction intersecting the second direction and is capable of abutting with the case of the drive unit from the one side in the second direction, and the second restriction part is provided between the case and the second side plate part. According to this structure, coming-off of the connecting part from the fitted part can be prevented by the first coming-off prevention part and the second coming-off prevention part.

In the present invention, it may be structured that a moving direction of the drive unit when the connecting part is to be fitted to the fitted part is the same direction as a direction of a force which is generated against twisting of the ice tray and is applied from the ice tray to the drive unit. According to this structure, when a twisting operation is performed on the ice tray, even in a case that a reaction force is applied to the drive unit, the force is applied to the connecting part as a force which makes the connecting part become fitted to the fitted part and thus the connecting part is hard to be disengaged from the fitted part. In other words, it may be structured that a moving direction of the drive unit when the connecting part is to be fitted to the fitted part is set in a reverse direction to a turning direction of the output shaft when ice pieces of the ice tray is separated.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An embodiment of the present invention will be described below with reference to the accompanying drawings. In the following descriptions, three directions intersecting each other are referred to as a first direction "X" (longitudinal direction), a second direction "Y" (width direction), and a third direction "Z" (upper and lower direction). Further, "X1" is indicated on one side in the first direction "X", "X2" is indicated on the other side in the first direction "X", "Y1" is indicated on one side in the second direction "Y", "Y2" is indicated on the other side in the second direction "Y", "Z1" is indicated on one side (upper side) in the third direction "Z" (upper and lower direction), and "Z2" is indicated on the other side (lower side) in the third direction "Z" (upper and lower direction).

(Entire Structure)

Figure 1:
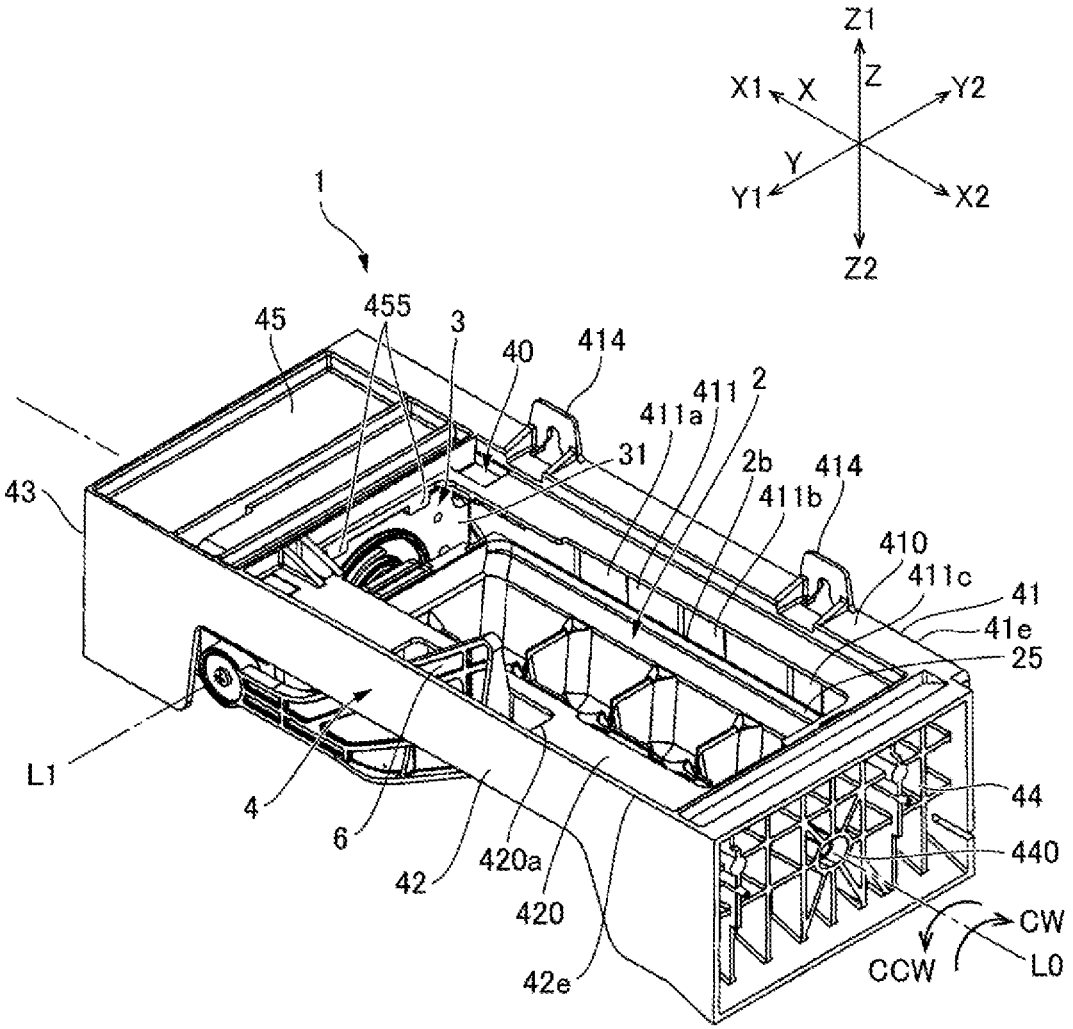
FIG. 1 is a perspective view showing an ice making device which is viewed from a side of a second side plate part and from an obliquely upper side in accordance with an embodiment of the present invention.
Figure 2:
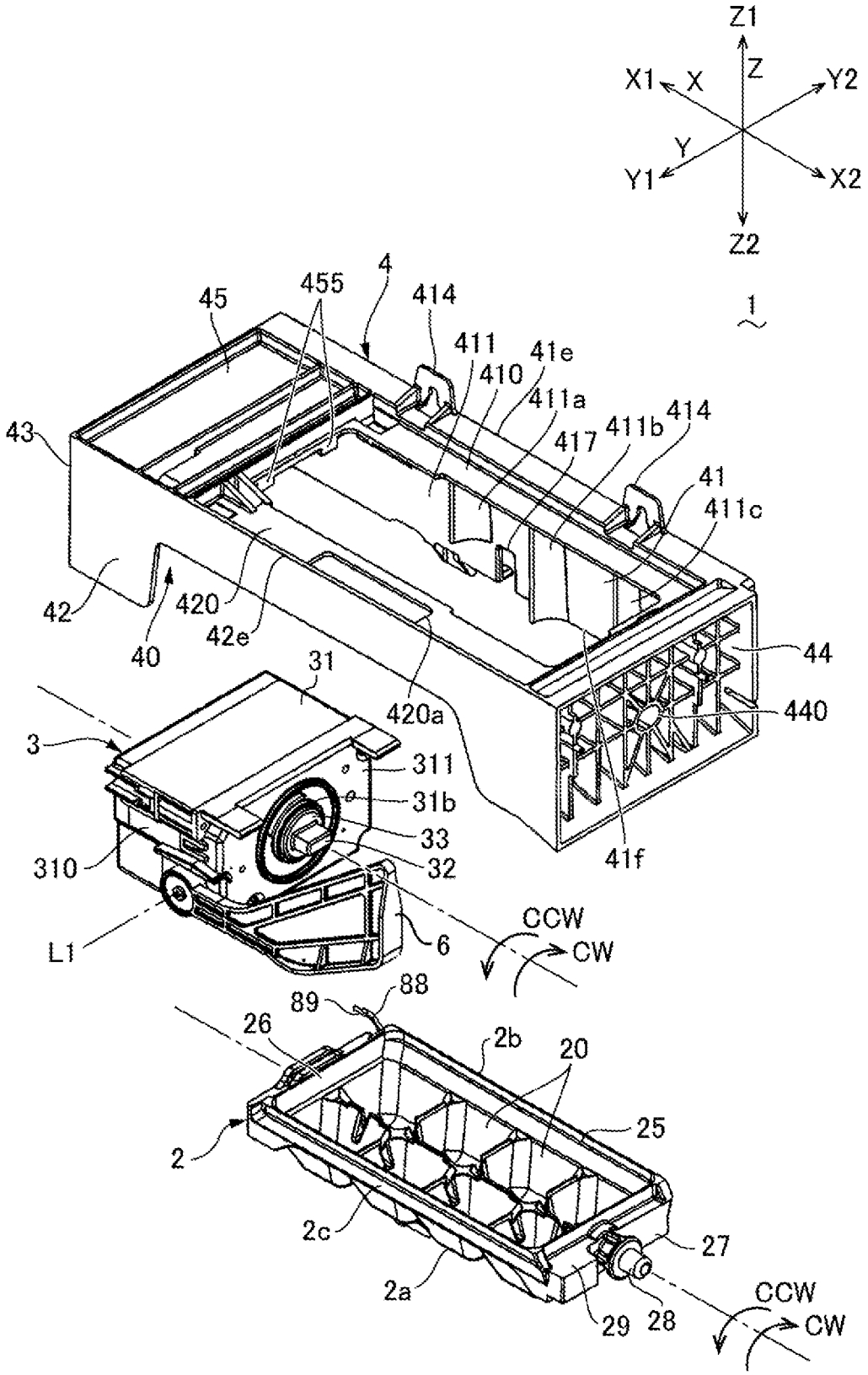
FIG. 2 is an exploded perspective view showing the ice making device shown in FIG. 1 which is viewed from a side of a second side plate part and from an obliquely upper side.
Figure 3:
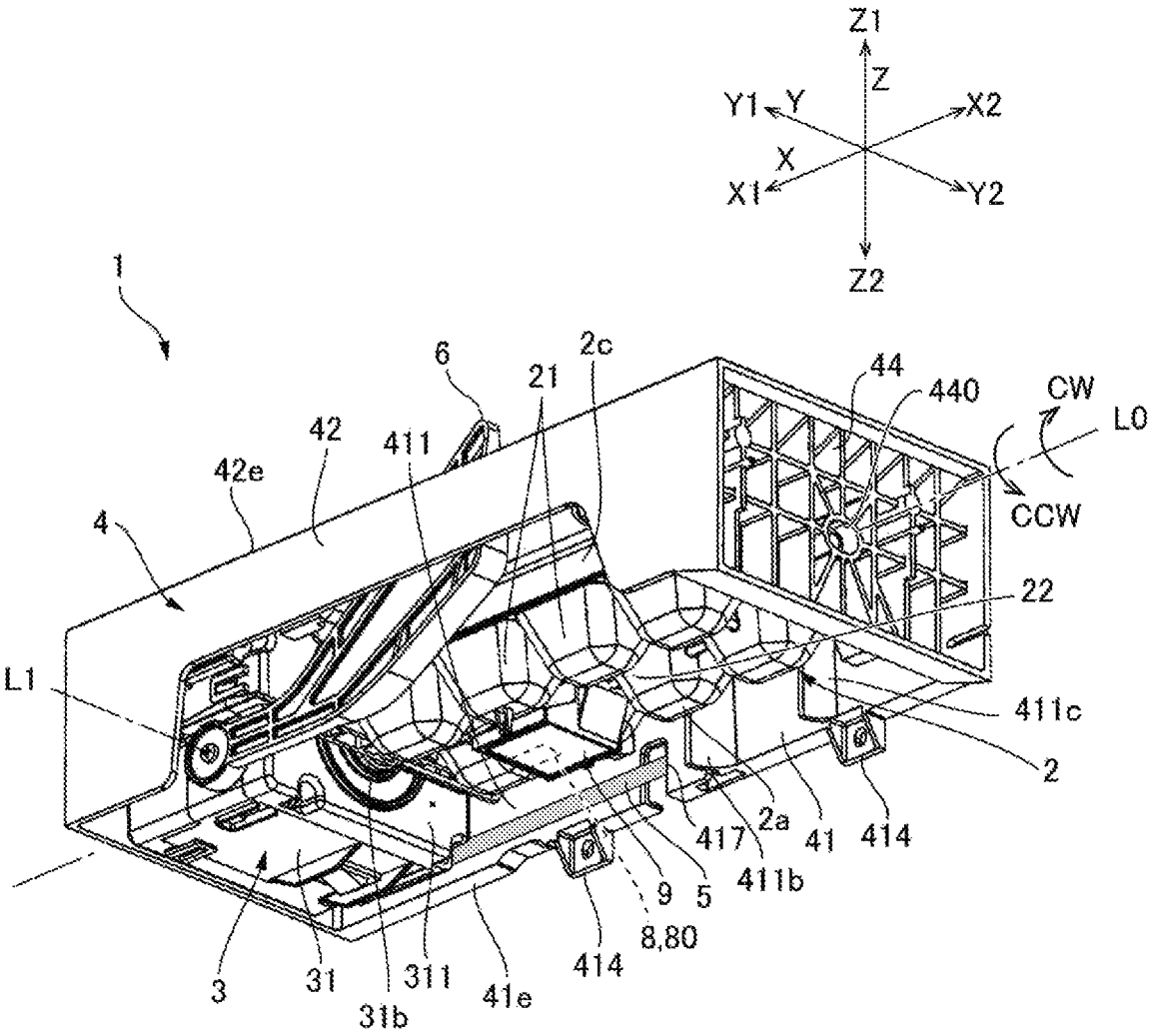
FIG. 3 is a perspective view showing the ice making device shown in FIG. 1 which is viewed from a side of a second side plate part and from an obliquely lower side.

FIG. 1 is a perspective view showing an ice making device 1 which is viewed from a side of a second side plate part 42 and from an obliquely upper side in accordance with an embodiment of the present invention. FIG. 2 is an exploded perspective view showing the ice making device 1 shown in FIG. 1 which is viewed from a side of the second side plate part 42 and from an obliquely upper side. FIG. 3 is a perspective view showing the ice making device 1 shown in FIG. 1 which is viewed from a side of the second side plate part 42 and from an obliquely lower side.

The ice making device 1 shown in FIGS. 1 through 3 includes an ice tray 2 whose water storage recessed parts 20 (cells) are disposed toward one side "Z1" (upper side) in the third direction "Z", a drive unit 3 (drive unit for an ice making device) which is disposed on one side "X1" in the first direction "X" with respect to the ice tray 2, and a frame 4 provided with a mounting part 40 on which the drive unit 3 is mounted. The ice making device 1 is mounted on a refrigerator main body (not shown) of a refrigerator and, in the refrigerator, water of a water tank (not shown) is supplied to the water storage recessed parts 20 of the ice tray 2 through a water supply pipe (not shown) and ice making is performed. When the ice making is completed, as an ice separating operation, the drive unit 3 drives the ice tray 2 to perform a reversing operation around an axial line "L0" extended in the first direction "X" and a twisting operation interlocked with the reversing operation and, as a result, ice pieces of the ice tray 2 are dropped to an ice storage container (not shown).

(Structure of Ice Tray 2)

The ice tray 2 is a structural member which is molded with resin material so that its planar shape is a substantially quadrangle and the material is structured to be capable of being resiliently deformed. In the ice tray 2, a plurality of water storage recessed parts 20 is arranged in the first direction "X" and the second direction "Y". For example, in the ice tray 2, two water storage recessed parts 20 are arranged as a pair in the second direction "Y" and four pairs are disposed in the first direction "X" on an inner side of a frame part 25 formed in a substantially quadrangular shape. In the frame part 25 of the ice tray 2, a wall part 26 located on one side "X1" in the first direction "X" is formed with a connecting part (not shown) which is connected with an output shaft 32 of the drive unit 3 on an axial line "L0", and a wall part 27 located on the other side "X2" in the first direction "X" is formed with a shaft part 28 which is turnably supported by the frame 4 on the axial line "L0". The wall part 27 of the ice tray 2 is formed with a turning restriction part 29 which is abutted with the frame 4 when the ice tray 2 is turned around the axial line "L0", and the turning restriction part 29 prevents turning of the ice tray 2 to make the ice tray 2 perform a twisting operation.

An under face 2*a* of the ice tray 2 is arranged with a plurality of protruded parts 21 reflecting shapes of the plurality of the water storage recessed parts 20. The under face 2*a* of the ice tray 2 is disposed with a temperature sensor 8 structured to detect a temperature of the ice tray 2, and the temperature sensor 8 is covered by a cover member 9 which is fixed to the under face 2*a* of the ice tray 2. Signal wiring lines 88 and 89 are extended from the temperature sensor 8 toward an inside of the drive unit 3. In this embodiment, the temperature sensor 8 is a thermistor 80.

(Structure of Drive Unit 3)

In FIG. 2, the drive unit 3 includes a motor (not shown) as a drive source, a rotation transmission mechanism (not shown) structured to transmit a rotating force of the motor, and a cam gear 33 to which the rotating force of the motor is transmitted through a rotation transmission mechanism on an inner side of a case 31 which is formed in a rectangular parallelepiped shape. A wiring line (not shown) for power feeding to the motor is extended from the drive unit 3 to an outer side of the frame 4. The cam gear 33 is provided with an output shaft 32 integrally molded with the cam gear 33 with which a connecting part of the ice tray 2 is connected. The output shaft 32 is protruded to an outer side of the case 31 from a hole 316 provided in an end plate 311 of the case 31. When ice pieces of the ice tray 2 are to be separated, the output shaft 32 is turned in a counterclockwise direction "CCW" with the axial line "L0" as a center and, when the ice tray 2 is to be returned to the original position, the output shaft 32 is turned in a clockwise direction "CW".

An ice detection lever 6 is disposed at a position adjacent to the ice tray 2 on one side "Y1" in the second direction "Y". An ice detection mechanism structured to operate the ice detection lever 6 so as to turn around the axial line "L1" interlocked with the cam gear 33 depending on a turning angle of the cam gear 33 is structured in an inside of the case 31 of the drive unit 3, and a switch mechanism which is operated based on a signal inputted from the temperature sensor 8 through the signal wiring lines 88 and 89, and the like are also structured in the inside of the case 31 of the drive unit 3.

(Structure of Frame 4)

The frame 4 is provided with a first side plate part 41 which is extended in the first direction "X" along a first side face 2*b* on the other side "Y2" in the second direction "Y" of the ice tray 2, and a second side plate part 42 which is extended in the first direction "X" along a second side face 2*c* on one side "Y1" in the second direction "Y" of the ice tray 2. The first side plate part 41 and the second side plate part 42 are faced in the second direction "Y" in parallel to each other. An ice detection lever 6 is disposed between the second side plate part 42 and the ice tray 2.

A first upper plate part 410 is projected toward the second side plate part 42 from an upper end 41*e* of the first side plate part 41 (edge on one side "Z1" in the third direction "Z"). The first upper plate part 410 is bent to a lower side at a midway position toward one side "Y1" in the second direction "Y" and then is projected toward the second side plate part 42. A second upper plate part 420 is projected from the vicinity of an upper end 42*e* of the second side plate part 42 (edge on one side "Z1" in the third direction "Z") toward the first side plate part 41. The ice tray 2 is set in an opened state toward an upper side (one side "Z1" in the third direction "Z") between the first upper plate part 410 and the second upper plate part 420. The second upper plate part 420 is formed with an opening part 420*a* in which an upper end part of the ice detection lever 6 is located on its inner side.

End parts of the first side plate part 41 and the second side plate part 42 on one side "X1" in the first direction "X" are overlapped with the drive unit 3 when viewed in the second direction "Y". The first side plate part 41 and the second side plate part 42 are connected with each other by a first wall part 43 in a plate shape, which is located at an end part on one side "X1" in the first direction "X", and a second wall part 44 located at an end part on the other side "X2" in the first direction "X". The first side plate part 41 and the second side plate part 42 are also connected with each other by an upper plate part 45 covering the drive unit 3 from an upper side on one side "X1" in the first direction "X". Therefore, in this embodiment, a space surrounded by the first side plate part 41, the second side plate part 42, the first wall part 43 and the upper plate part 45 of the frame 4 is structured to be a mounting part 40 for the drive unit 3. The mounting part 40 is structured as an opened state toward a lower side (the other side "Z2" in the third direction "Z"). The second wall part 44 is a wall provided with a plurality of holes which are structured by a plurality of ribs in a plate shape connected with each other. A shaft hole 440 is formed at the center so as to turnably support the shaft part 28 of the ice tray 2.

In the first side plate part 41, a plurality of reinforcing ribs 411*a*, 411*b* and 411*c* are formed so as to be extended in the upper and lower direction on a wall (inner wall 411) on a side where the ice tray 2 is located. In a wall (outer wall) of the first side plate part 41 on an opposite side to the ice tray 2, an upper end 41*e* and a lower end 41*f* of the first side plate part 41 are formed with a plurality of attaching parts 414 on the other side "X2" in the first direction "X" with respect to the drive unit 3 for fixing the frame 4 to a refrigerator main body (not shown) when the ice making device 1 is to be mounted on the refrigerator main body. The lower end 41*f* of the first side plate part 41 is formed with a penetration part 417 formed of a cut-out part between the attaching parts 414 adjacent to each other in the first direction "X". A wiring line 5 structured to supply electrical power to the drive unit 3 is extended from the drive unit 3 along the inner wall 411 of the first side plate part 41 toward the other side "X2" in the first direction "X" and then is extended outside through the penetration part 417.

Therefore, when the drive unit 3 is going to make the ice tray 2 perform a twisting operation in order to perform an ice separating operation, even in a case that a large force is applied to the frame 4 due to its reaction force, transmission of the force to the penetration part 417 and the like of the first side plate part 41 is restrained by the attaching part 414 which is fixed to the refrigerator main body on one side "X1" in the first direction "X" with respect to the penetration part 417. Accordingly, stress can be restrained from being concentrated on the penetration part 417 and the like in the first side plate part 41 and thus the first side plate part 41 can be restrained from being damaged in the vicinity of the penetration part 417.

(Fixing Structure of Drive Unit 3 to Frame 4)

Figure 4:
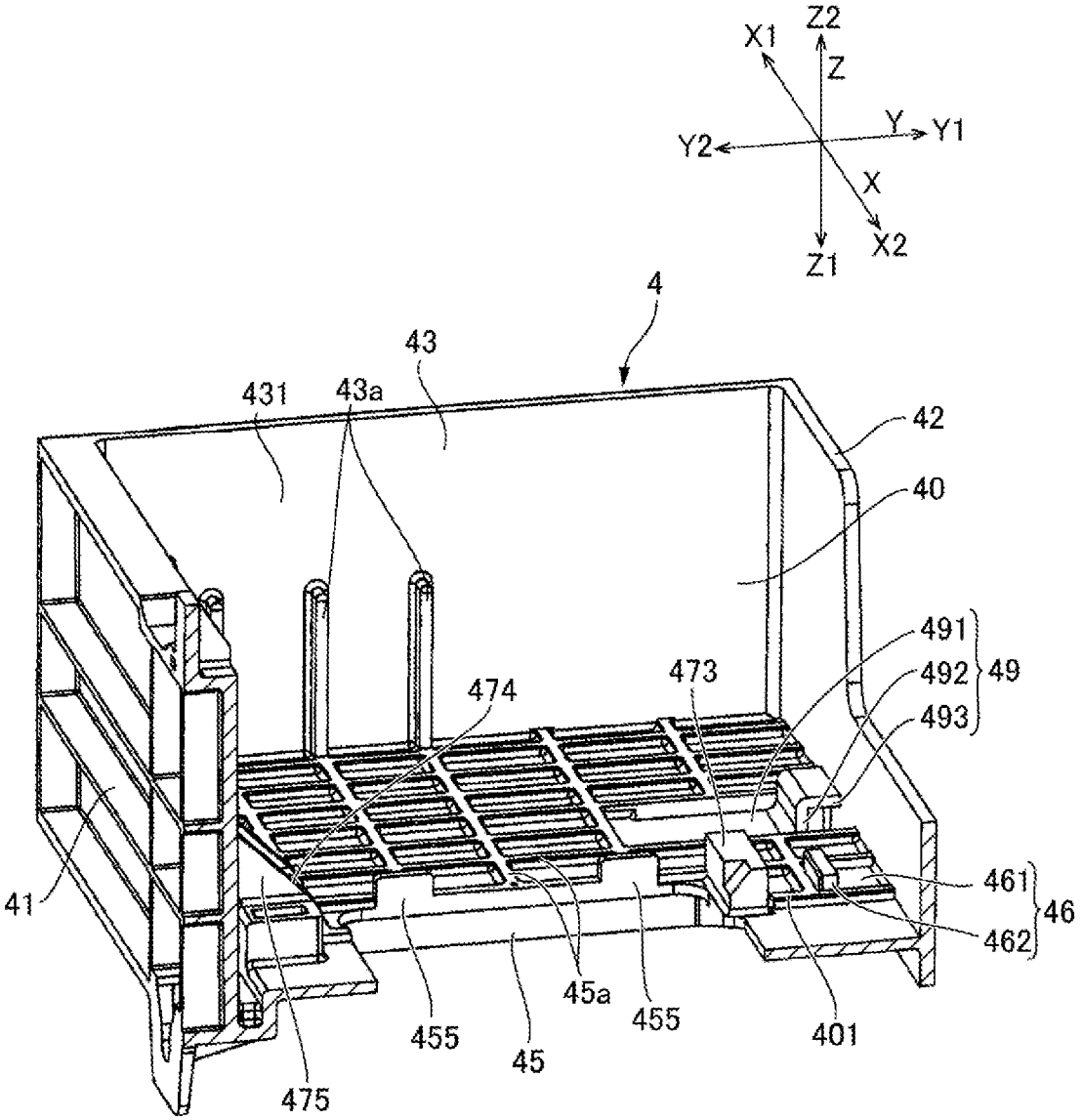
FIG. 4 is a perspective view showing a structure of a mounting part of a frame which is used in the ice making device shown in FIG. 1.
Figure 5:
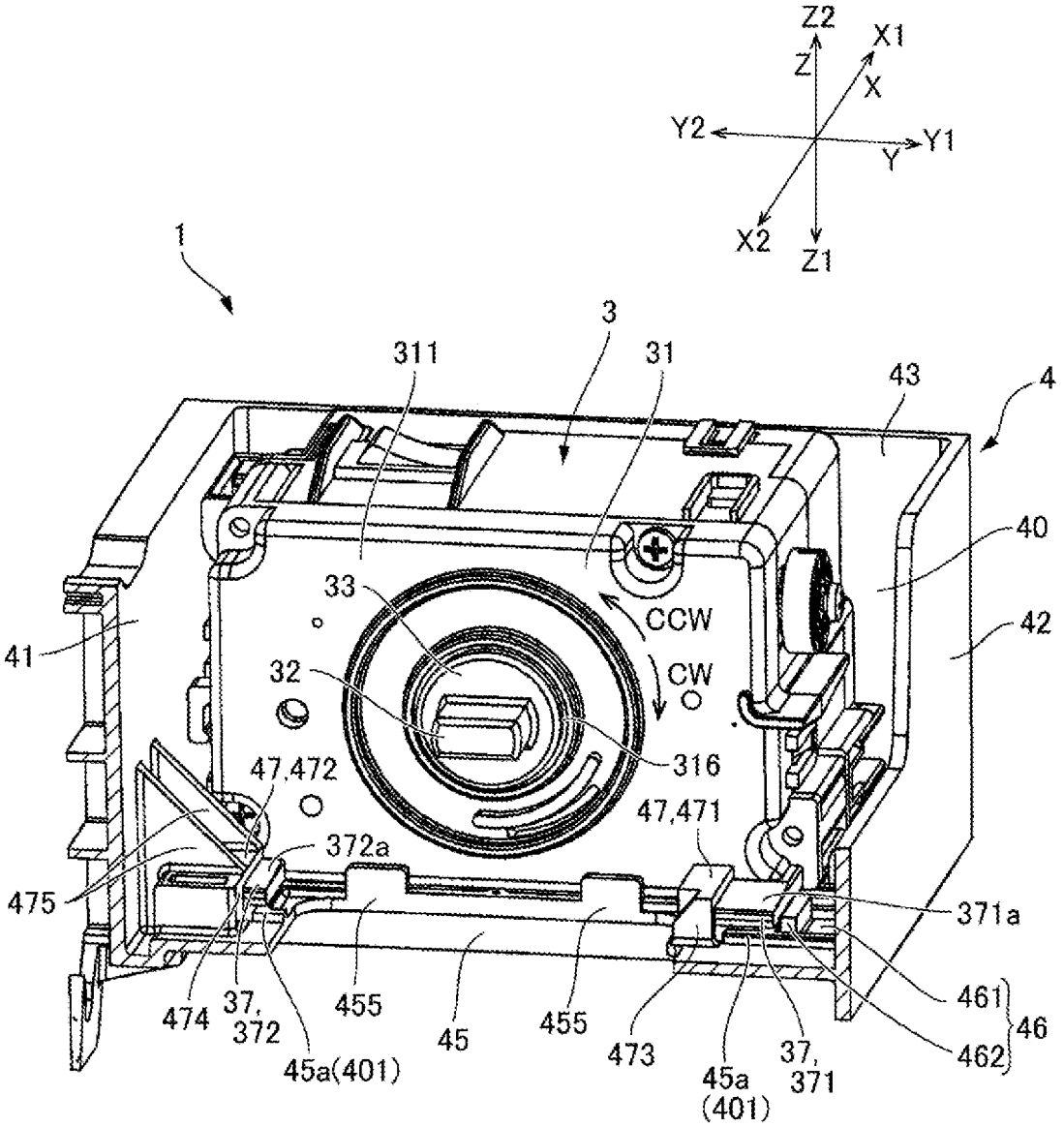
FIG. 5 is a perspective view showing a state that a drive unit is mounted on the mounting part shown in FIG. 4.
Figure 6:
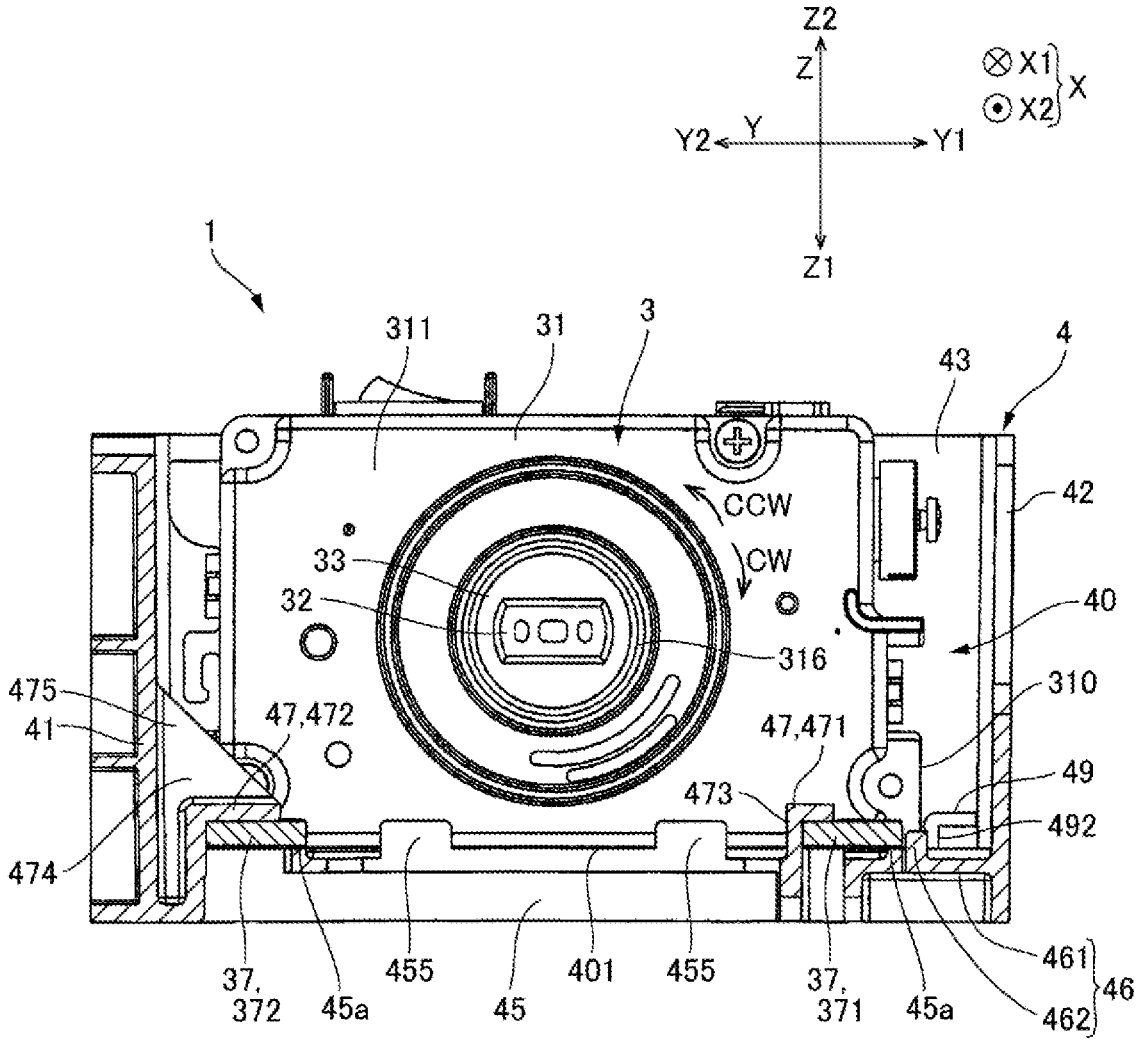
FIG. 6 is a cross-sectional view showing a state that a drive unit is mounted on the mounting part shown in FIG. 4 and is cut at a position passing connecting parts.
Figure 7A:
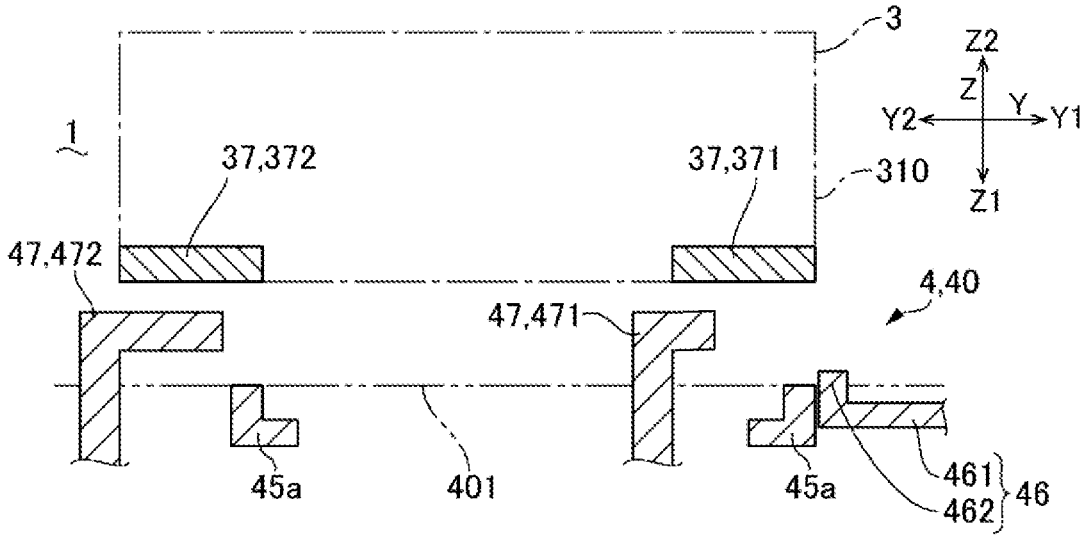
FIGS. 7A, 7B and 7C are explanatory views schematically showing states that a drive unit is to be mounted on the mounting part shown in FIG. 4.
Figure 7B:
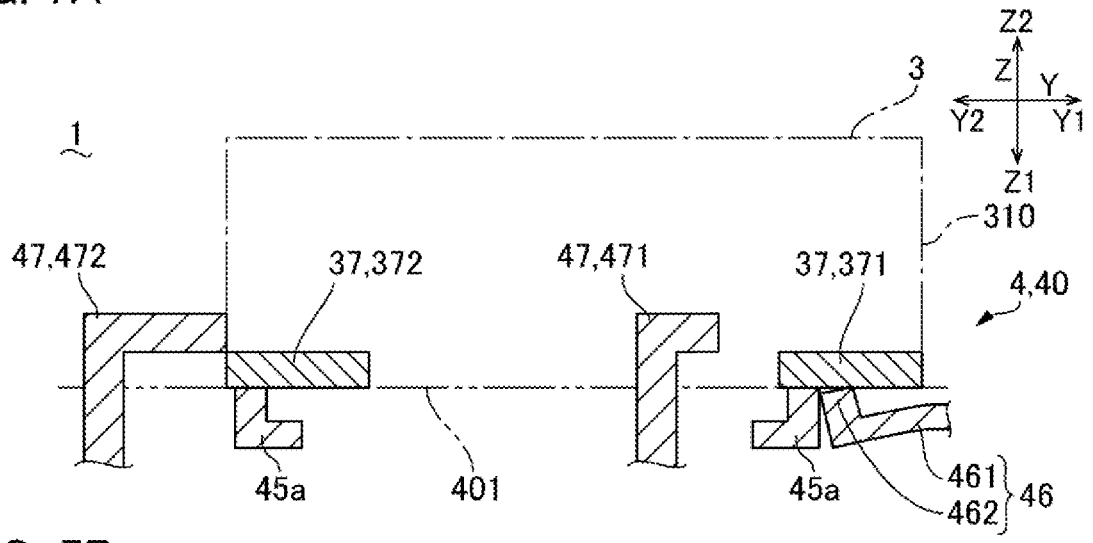
Figure 7C:
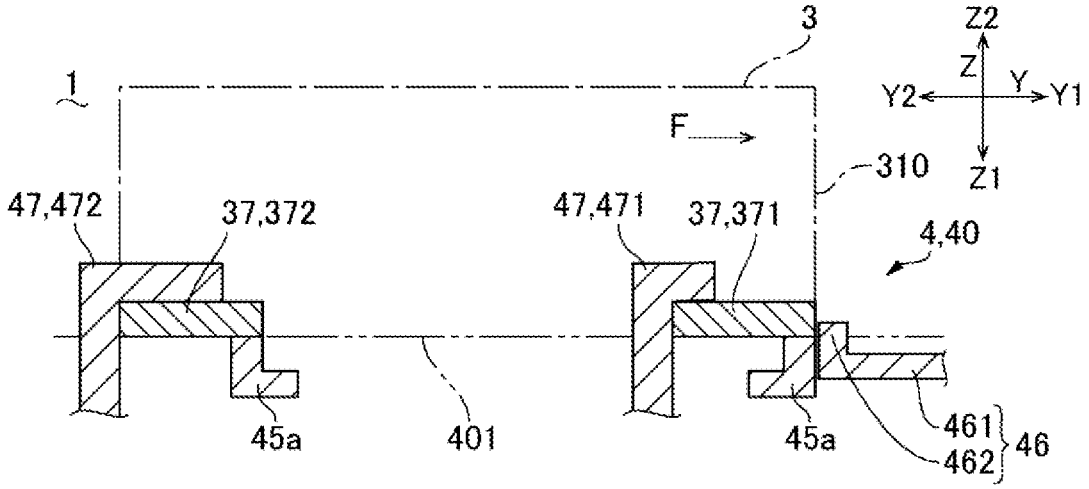
Figure 8A:
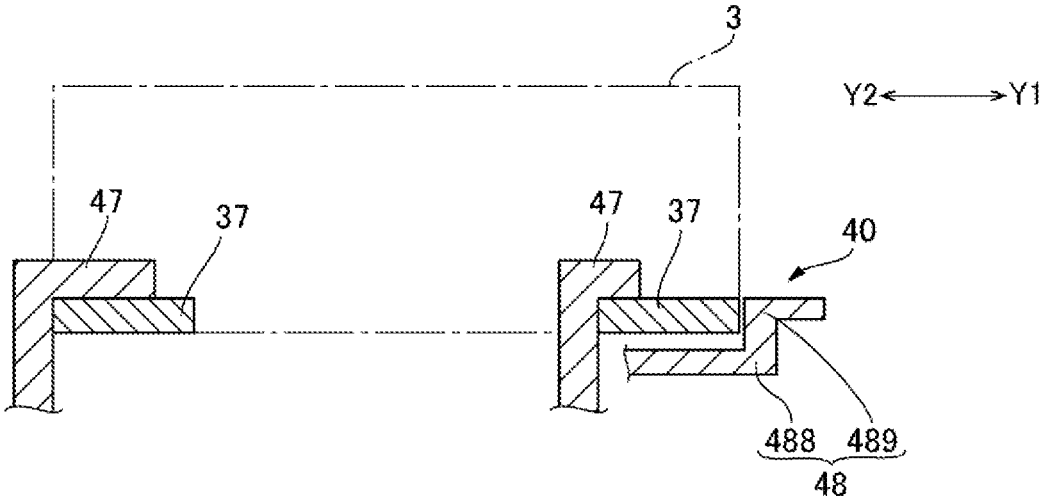
FIG. 8A PRIOR ART
FIGS. 8A and 8B are explanatory views schematically showing states that a drive unit is mounted on a mounting part of a frame in a conventional ice making device.
Figure 8B:
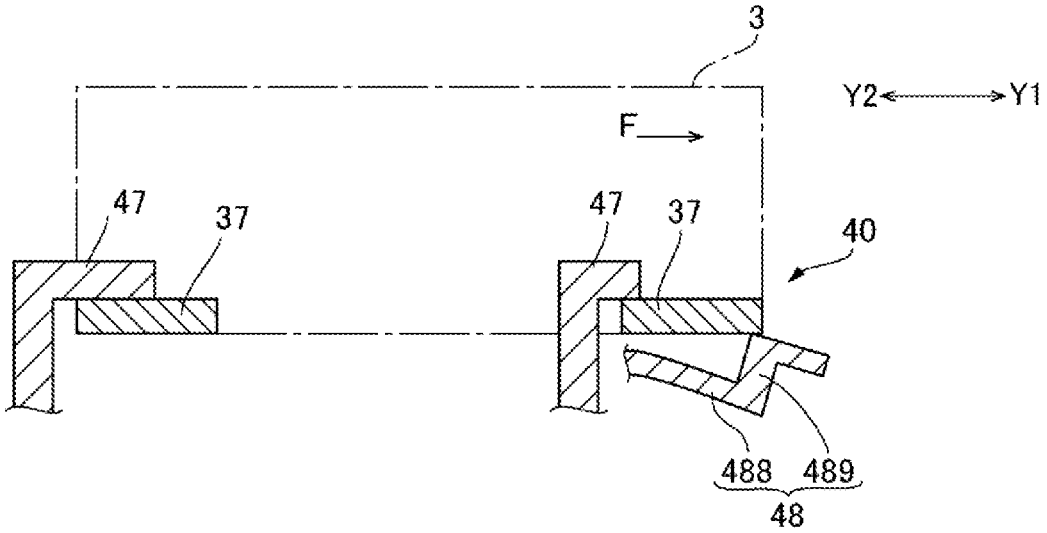
FIG. 8B PRIOR ART

FIG. 4 is a perspective view showing a structure of the mounting part 40 of the frame 4 which is used in the ice making device 1 shown in FIG. 1. FIG. 5 is a perspective view showing a state that the drive unit 3 is mounted on the mounting part 40 shown in FIG. 4. FIG. 6 is a cross-sectional view showing a state that the drive unit 3 is mounted on the mounting part 40 shown in FIG. 4 and is cut at a position passing connecting parts 37. FIGS. 7A, 7B and 7C are explanatory views schematically showing states that the drive unit 3 is to be mounted on the mounting part 40 shown in FIG. 4. FIG. 7A is an explanatory view showing a state before the drive unit 3 is mounted on the mounting part 40, FIG. 7B is an explanatory view showing a midway state when the drive unit 3 is being mounted on the mounting part 40, and FIG. 7C is an explanatory view showing a state after the drive unit 3 has been mounted on the mounting part 40. FIGS. 4 through 7 show the drive unit 3 and the mounting part 40 in reversed states in the upper and lower direction and the right and left direction with respect to FIGS. 1 through 3.

As shown in FIGS. 4 through 7A, a support face 401 is structured in the mounting part 40 of the frame 4 so as to support the drive unit 3 from one side "Z1" (upper side) in the third direction "Z". In this embodiment, an inner face (under face) of the upper plate part 45 is formed with reinforcing ribs 45*a* which are extended in the first direction "X" and the second direction "Y", and the support face 401 is an imaginary face which is determined by the reinforcing ribs 45*a*. Therefore, strength of the upper plate part 45 and the support face 401 can be increased by the reinforcing ribs 45*a*. Further, an inner face 431 of the first wall part 43 facing the other side "X2" in the first direction "X" is formed with a plurality of reinforcing ribs 43*a* which are extended from the reinforcing ribs 45*a* to midway positions toward the other side "Z2" in the third direction "Z".

As described below, the mounting part 40 of the frame 4 is structured with a fitted part 47 to which a connecting part 37 of the drive unit 3 is fitted when the drive unit 3 has been moved from one side "Y1" to the other side "Y2" in the second direction "Y", and a first coming-off prevention part 46 which is located at a position capable of abutting with the drive unit 3 from one side "Y1" in the second direction "Y" to prevent coming-off of the connecting part 37 from the fitted part 47 when the drive unit 3 has been moved from one side "Y1" to the other side "Y2" in the second direction "Y". The fitted part 47 and the first coming-off prevention part 46 are respectively provided in the frame 4 at positions on the other side "X2" in the first direction "X" with respect to the case 31 of the drive unit 3, specifically, with respect to the end plate 311 of the case 31. Further, the mounting part 40 is structured with a second coming-off prevention part 49 which is located at a position separated to one side "X1" in the first direction "X" from the first coming-off prevention part 46 and capable of abutting with the drive unit 3 from one side "Y1" in the second direction "Y" to prevent coming-off of the connecting part 37 from the fitted part 47 when the drive unit 3 has been moved from one side "Y1" to the other side "Y2" in the second direction "Y".

The case 31 of the drive unit 3 is formed, as the connecting part 37, with a first plate part 371 which is protruded from an end part on one side "Y1" in the second direction "Y" of the end plate 311 to the other side "X2" in the first direction "X" in a state that its plate thickness direction is directed in the third direction "Z", and a second plate part 372 which is protruded from an end part on the other side "Y2" of the end plate 311 to the other side "X2" in the first direction "X" at a position separated from the first plate part 371 to the other side "Y2" in the second direction "Y" in a state that its plate thickness direction is directed in the third direction "Z". On the other hand, the upper plate part 45 of the frame 4 is formed, as the fitted part 47, a first pawl 471 which is protruded toward the other side "Z2" in the third direction "Z" and whose tip end side is bent to one side "Y1" in the second direction "Y", and a second pawl 472 which is protruded toward the other side "Z2" in the third direction "Z" and whose tip end side is bent to one side "Y1" in the second direction "Y" at a position separated from the first pawl 471 to the other side "Y2" in the second direction "Y". Therefore, when the drive unit 3 has been moved from one side "Y1" to the other side "Y2" in the second direction "Y", the first plate part 371 is fitted to an inner side of the first pawl 471 and the second plate part 372 is fitted to an inner side of the second pawl 472 and, in this manner, the drive unit 3 is fixed to the mounting part 40 of the frame 4.

In this state, an overlapping width of the second plate part 372 with the second pawl 472 in the second direction "Y" is larger than an overlapping width of the first plate part 371 with the first pawl 471 in the second direction "Y". Further, an overlapping area of the first plate part 371 with the support face 401 (overlapping area of the first plate part 371 with the reinforcing ribs 45*a* of the upper plate part 45) is larger than an overlapping area of the second plate part 372 with the support face 401 (overlapping area of the second plate part 372 with the reinforcing ribs 45*a* of the upper plate part 45).

Positions of the first pawl 471 and the second pawl 472 in the second direction "Y" are set so that a distance in the second direction "Y" between the drive unit 3 and the second side plate part 42 of the frame 4 is wider than a distance in the second direction "Y" between the drive unit 3 and the first side plate part 41 of the frame 4. Further, the first plate part 371 and the second plate part 372 are respectively fitted to the first pawl 471 and the second pawl 472 from one side "Y1" in the second direction "Y". Therefore, in order to fix the drive unit 3 to the mounting part 40 of the frame 4, a space can be secured so that the drive unit 3 is first placed on one side "Y1" with respect to a center in the second direction "Y" and, after that, the drive unit 3 is moved to the other side "Y2" in the second direction "Y". Further, a space for connecting the ice detection lever 6 shown in FIG. 1 and the like with the drive unit 3 can be secured between the drive unit 3 and the second side plate part 42 of the frame 4. In this embodiment, plate-shaped positioning parts 455 protruded toward the other side "Z2" in the third direction "Z" are formed in the upper plate part 45 on the other side "X2" in the first direction "X". The drive unit 3 is abutted with the plate-shaped positioning parts 455 and is positioned on the other side "X2" in the first direction "X".

The first pawl 471 is structured with a protruded part 473, which is protruded from the upper plate part 45 to the other side "Z2" in the third direction "Z", and a recessed part provided in the protruded part 473 so as to be opened toward one side "Y1" in the second direction "Y" and toward one side "X1" in the first direction "X". The second pawl 472 is structured with a protruded part 474, which is protruded from the upper plate part 45 to the other side "Z2" in the third direction "Z", and a recessed part provided in the protruded part 474 so as to be opened toward one side "Y1" in the second direction "Y" and toward one side "X1" in the first direction "X". The protruded part 474 is connected with the first side plate part 41 through triangular reinforcing plates 475.

The first plate part 371 and the second plate part 372 are formed with inclined parts 371*a* and 372*a* which are inclined so that their plate thicknesses are reduced from one side "X1" toward the other side "X2" in the first direction "X". Therefore, when the first plate part 371 is to be fitted to an inner side of the first pawl 471, the first plate part 371 is easily fitted to the inner side of the first pawl 471 from an end part on the other side "X2" in the first direction "X" where plate thickness is made thin and, after that, the drive unit 3 is slid along the support face 401 toward the other side "Y2" in the second direction "Y". Further, when the second plate part 372 is to be fitted to an inner side of the second pawl 472, the second plate part 372 is easily fitted to the inner side of the second pawl 472 from an end part on the other side "X2" in the first direction "X" where plate thickness is made thin and, after that, the drive unit 3 is slid along the support face 401 toward the other side "Y2" in the second direction "Y".

In this embodiment, the first coming-off prevention part 46 is provided with a first arm part 461, which is extended from the second side plate part 42 along the support face 401 from one side "Y1" to the other side "Y2" in the second direction "Y" on one side "Y1" in the second direction "Y" with respect to the first pawl 471, and a first restriction part 462 which is protruded from a tip end side of the first arm part 461 in a direction intersecting the second direction "Y" (to the other side "Z2" in the third direction "Z") so as to be capable of abutting with the first plate part 371 of the drive unit 3 from one side "Y1" in the second direction "Y". Therefore, as shown in FIG. 7B, when the drive unit 3 is to be mounted on the mounting part 40, the first arm part 461 can be resiliently deformed so that the first restriction part 462 is retreated to one side "Z1" in the third direction "Z". In addition, when completing the mounting of the drive unit 3 on the mounting part 40, the first restriction part 462 is returned to a position where the first restriction part 462 is capable of abutting with the first plate part 371 formed in the case 31 of the drive unit 3 from one side "Y1" in the second direction "Y". In other words, when completing the mounting of the drive unit 3 on the mounting part 40, the first restriction part 462 is returned to a state that the first restriction part 462 is abutted with the first plate part 371 from one side "Y1" in the second direction "Y" and, alternatively, the first restriction part 462 is returned to a position where the first restriction part 462 faces the first plate part 371 on one side "Y1" in the second direction "Y" through a gap space.

The second coming-off prevention part 49 is provided with a second arm part 491, which is extended along the support face 401 from the other side "Y2" to one side "Y1" in the second direction "Y" on one side "X1" in the first direction "X" with respect to the first coming-off prevention part 46, a second restriction part 492 which is protruded from a tip end side of the second arm part 491 in a direction intersecting the second direction "Y" (to the other side "Z2" in the third direction "Z") and is capable of abutting with the drive unit 3 from one side "Y1" in the second direction "Y", and a tip end part 493 which is bent from a tip end part of the second restriction part 492 to one side "Y1" in the second direction "Y". Therefore, although not shown, when the drive unit 3 is to be mounted on the mounting part 40, the second arm part 491 can be resiliently deformed so that the second restriction part 492 and the tip end part 493 are retreated to one side "Z1" in the third direction "Z" and, when completing the mounting of the drive unit 3 on the mounting part 40, the second restriction part 492 is returned to a position where the second restriction part 492 is capable of abutting with the side wall 310 of the case 31 of the drive unit 3 from one side "Y1" in the second direction "Y". In other words, when completing the mounting of the drive unit 3 on the mounting part 40, the second restriction part 492 is located between the side wall 310 of the case 31 and the second side plate part 42 of the frame 4, and the second restriction part 492 is returned to a state that the second restriction part 492 is abutted with the side wall 310 of the case 31 of the drive unit 3 from one side "Y1" in the second direction "Y" and, alternatively, the second restriction part 492 is returned to a position where the second restriction part 492 faces the side wall 310 on one side "Y1" in the second direction "Y" through a gap space.

In this embodiment, the first coming-off prevention part 46 and the second coming-off prevention part 49 are respectively structured so that three sides are cut off in the upper plate part 45. Further, portions of the upper plate part 45 where the first pawl 471 and the second pawl 472 are formed are formed as opening parts. Therefore, when the frame 4 is to be molded by using resin, the first coming-off prevention part 46, the second coming-off prevention part 49, the first pawl 471 and the second pawl 472 can be formed in the upper plate part 45 by using a die structured to be drawn in the upper and lower direction without using a slide core.

(Operation)

In the ice making device 1 in this embodiment, in an ice making step, water is supplied to an ice tray 2 horizontally disposed so that water storage recessed parts 20 face an upper side through a water supply pipe (not shown) and water is filled in the water storage recessed parts 20. After that, the water filled in the ice tray 2 is frozen by a cold air supplied from a cooling part (not shown). Whether an ice making has been completed or not is determined according to whether or not a temperature of the ice tray 2 has reached a predetermined temperature or lower based on a temperature sensor 8 (thermistor 80) attached to the ice tray 2.

When ice making has been completed, an ice quantity in an ice storage container (not shown) arranged on a lower side with respect to the ice tray 2 is detected by an ice detection lever 6. Specifically, the ice detection lever 6 is driven and moved downward by a drive unit 3. In this case, when the ice detection lever 6 has been moved down to a predetermined position, it is judged that the ice quantity in the ice storage container is insufficient. On the other hand, in a case that the ice detection lever 6 is abutted with an ice piece in the ice storage container before moving down to the predetermined position, it is judged that an ice quantity in the ice storage container is full. In the case that the ice quantity in the ice storage container is full, after waiting for a predetermined time period, the ice quantity in the ice storage container will be detected by the ice detection lever 6 again.

When an ice quantity in the ice storage container is insufficient, an ice separating operation of the ice tray 2 is performed. Specifically, an output shaft 32 of the drive unit is driven and turned and the ice tray 2 is turned in a counterclockwise direction "CCW" with an axial line "L0" as a center. When the ice tray 2 is turned around by a predetermined turning angle of 90° or more (for example, 120°) from a horizontally disposed first position, a turning restriction part 29 of the ice tray 2 is abutted with a frame 4. In this state, further turning of the ice tray 2 is restricted and thus the ice tray 2 is twisted and deformed. As a result, ice pieces in the ice tray 2 are separated from the ice tray 2 and dropped into the ice storage container arranged on a lower side with respect to the ice tray 2.

When the above-mentioned ice separating operation is to be performed, a force is applied to the drive unit 3 from the ice tray 2 so as to resist twisting applied to the ice tray 2. In this case, a force applied to the drive unit 3 is a force in a clockwise direction "CW" with the axial line "L0" as a center. On the other hand, when the drive unit 3 is to be fixed to the mounting part 40 of the frame 4, a direction in which the drive unit 3 is moved (direction in which a connecting part 37 is fitted to the fitted part 47) is the clockwise direction "CW" with the axial line "L0" as a center. Therefore, when a twisting operation is performed on the ice tray 2, the direction of the force applied to the drive unit 3 from the ice tray 2 is the same as the direction in which the drive unit 3 is moved when the drive unit 3 is to be fixed to the mounting part 40. In other words, when the drive unit 3 is to be fixed to the mounting part 40 of the frame 4, a direction in which the drive unit 3 is moved (direction in which the connecting part 37 is fitted to the fitted part 47) is the clockwise direction "CW", which is the reverse direction to the counterclockwise direction "CCW", specifically, a turning direction of the output shaft 32 when the ice separating operation is performed on the ice tray 2. Therefore, when a twisting operation is performed on the ice tray 2, a force is applied to the drive unit 3 in a direction that the connecting part 37 (first plate part 371 and second plate part 372) is fitted to the fitted part 47 (first pawl 471 and second pawl 472) and a force is not applied in a direction that the connecting part 37 is disengaged from the fitted part 47.

Further, when the twisting operation is performed on the ice tray 2, the drive unit 3 is subjected to a force in the clockwise direction "CW" from the ice tray 2 with the axial line "L0" as a center. Therefore, the first plate part 371 is pressed toward the support face 401 and the second plate part 372 is pressed toward a tip end part of the second pawl 472. In this case, an overlapping width of the second plate part 372 with the second pawl 472 in the second direction "Y" is larger than an overlapping width of the first plate part 371 with the first pawl 471 in the second direction "Y". Further, an overlapping area of the first plate part 371 with the support face 401 (overlapping area of the first plate part 371 with reinforcing ribs 45*a* of the upper plate part 45) is larger than an overlapping area of the second plate part 372 with the support face 401 (overlapping area of the second plate part 372 with the reinforcing ribs 45*a* of the upper plate part 45). Therefore, when the twisting operation is performed on the ice tray 2, even in a case that a force in the clockwise direction "CW" with the axial line "L0" as a center is applied to the drive unit 3 from the ice tray 2, a state that the drive unit 3 is fixed to the frame 4 can be surely maintained.

After the above-mentioned ice separating operation has been performed, the drive unit 3 turns the ice tray 2 in a reverse direction, i.e., in the clockwise direction "CW" so that the water storage recessed parts 20 face to an upper side with the axial line "L0" as a center, and the above-mentioned operations are repeated.

Principal Effects in this Embodiment

As described above, in the ice making device 1 in this embodiment, when the drive unit 3 is moved from one side "Y1" to the other side "Y2" in the second direction "Y", the connecting part 37 (first plate part 371 and second plate part 372) of the drive unit 3 is fitted to the fitted part 47 (first pawl 471 and second pawl 472) of the frame 4 and thus the drive unit 3 can be fixed to the mounting part 40 of the frame 4. In this state, a first coming-off prevention part 46 of the frame 4 is abutted with the drive unit 3 from one side "Y1" in the second direction "Y" and thus coming-off of the connecting part 37 from the fitted part 47 can be prevented. In this embodiment, the first coming-off prevention part 46 is structured such that the first restriction part 462 formed at a tip end side of a first arm part 461 extended from one side "Y1" to the other side "Y2" in the second direction "Y" is capable of abutting with the drive unit 3 from one side "Y1" in the second direction "Y". Therefore, as shown in FIG. 7C, even in a case that a force "F" is applied to the drive unit 3 toward one side "Y1" in the second direction "Y", the first arm part 461 is hard to be resiliently bent in a direction that the first restriction part 462 is disengaged from the drive unit 3. Accordingly, the connecting part 37 provided in the drive unit 3 is hard to be disengaged from the fitted part 47 provided in the frame 4.

Further, in the first coming-off prevention part 46, the first arm part 461 is extended along the support face 401 and the first restriction part 462 is protruded from a tip end side of the first arm part 461 toward the other side "Z2" in the third direction "Z". Therefore, when the drive unit 3 is to be mounted on the mounting part 40 of the frame 4, the first restriction part 462 is pressed by the drive unit 3 and the first arm part 461 is resiliently deformed and thus the drive unit 3 can be easily mounted on the mounting part 40.

Further, the first coming-off prevention part 46 is abutted with the first plate part 371 which is fitted to the first pawl 471 to prevent coming-off of the first plate part 371 and thus the first plate part 371 is hard to be disengaged from the first pawl 471.

Further, the mounting part 40 is formed with a second coming-off prevention part 49 at a position separated from the first coming-off prevention part 46 in the first direction "X" in addition to the first coming-off prevention part 46. Therefore, coming-off of the connecting part 37 from the fitted part 47 can be surely prevented and the drive unit 3 is hard to be inclined. Further, in the second coming-off prevention part 49, a second arm part 491 is extended along the support face 401, and a second restriction part 492 is protruded from a tip end side of the second arm part 491 toward the other side "Z2" in the third direction "Z". Therefore, when the drive unit 3 is to be mounted on the mounting part 40 of the frame 4, the second restriction part 492 is pressed by the drive unit 3 and the second arm part 491 is resiliently deformed and thus the drive unit 3 can be easily mounted on the mounting part 40.

OTHER EMBODIMENTS

Although the present invention has been shown and described with reference to a specific embodiment, various changes and modifications will be apparent to those skilled in the art from the teachings herein. For example, in the embodiment described above, the plate-shaped connecting part 37 is provided in the drive unit 3 and the pawl-shaped fitted part 47 is provided in the frame 4. However, it may be structured that a pawl-shaped connecting part is provided in the drive unit 3 and a plate-shaped fitted part is provided in the frame 4.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray comprising water storage recessed parts which are disposed upward;

a drive unit structured to make the ice tray perform a reversing operation around an axial line extended in a first direction intersecting an upper and lower direction and perform a twisting operation interlocked with the reversing operation; and a frame on which the drive unit is mounted;

wherein the frame comprises in a mounting part for the drive unit:

a fitted part to which a connecting part of the drive unit is fitted when the drive unit has been moved from one side in a second direction intersecting the first direction to the other side in the second direction; and a first coming-off prevention part structured to prevent coming-off of the connecting part from the fitted part when the drive unit has been moved from the one side in the second direction to the other side in the second direction;

wherein the first coming-off prevention part comprises:

a first arm part which is extended from the one side in the second direction to the other side in the second direction; and a first restriction part which is protruded from a tip end side of the first arm part in a direction intersecting the second direction and is capable of abutting with the drive unit from the one side in the second direction, wherein the mounting part comprises a support face which supports the drive unit from one side in a third direction intersecting the first direction and the second direction in a state that the connecting part is fitted to the fitted part, and the first coming-off prevention part is structured so that the first arm part is extended along the support face and the first restriction part is protruded from a tip end side of the first arm part toward the other side in the third direction, wherein the fitted part comprises a first pawl which is protruded toward the other side in the third direction and a tip end side of the first pawl is bent to the one side in the second direction, and the drive unit comprises, as the connecting part, a first plate part wherein a plate thickness direction of the first plate part is directed in the third direction and which is protruded from one side in the first direction to the other side in the first direction and is fitted to an inner side of the first pawl, wherein the fitted part comprises a second pawl which is protruded toward the other side in the third direction and a tip end side of the second pawl is bent to the one side in the second direction at a position separated from the first pawl to the other side in the second direction, and the drive unit further comprises, as the connecting part, a second plate part wherein a plate thickness direction of the second plate part is directed in the third direction and which is protruded from the one side in the first direction to the other side in the first direction and is fitted to an inner side of the second pawl at a position separated from the first plate part to the other side in the second direction.

2. The ice making device according to claim 1, wherein the first restriction part is capable of abutting with the first plate part from the one side in the second direction.

3. The ice making device according to claim 1, wherein the first plate part comprises an inclined part which is inclined so that the plate thickness of the first plate part is reduced from the one side in the first direction toward the other side in the first direction.

4. The ice making device according to claim 1, wherein the second plate part comprises an inclined part which is inclined so that the plate thickness of the second plate part is reduced from the one side in the first direction toward the other side in the first direction.

5. The ice making device according to claim 1, wherein the support face is an imaginary face determined by reinforcing ribs which are formed in a portion of the mounting part overlapped with the drive unit.

6. An ice making device comprising:

an ice tray comprising water storage recessed parts which are disposed upward;

a drive unit structured to make the ice tray perform a reversing operation around an axial line extended in a first direction intersecting an upper and lower direction and perform a twisting operation interlocked with the reversing operation; and a frame on which the drive unit is mounted;

wherein the frame comprises in a mounting part for the drive unit:

a fitted part to which a connecting part of the drive unit is fitted when the drive unit has been moved from one side in a second direction intersecting the first direction to the other side in the second direction; and a first coming-off prevention part structured to prevent coming-off of the connecting part from the fitted part when the drive unit has been moved from the one side in the second direction to the other side in the second direction;

wherein the first corning-off prevention part comprises:

a first arm part which is extended from the one side in the second direction to the other side in the second direction; and a first restriction part which is protruded from a tip end side of the first arm part in a direction intersecting the second direction and is capable of abutting with the drive unit from the one side in the second direction the mounting part comprises a second coming-off prevention part which is provided at a position separated from the first coming-off prevention part in the first direction and is capable of abutting with the drive unit from the one side in the second direction and prevents coming-off of the connecting part from the fitted part when the drive unit has been moved from the one side in the second direction to the other side in the second direction, and the second corning-off prevention part comprises:

a second arm part which is extended from the other side in the second direction to the one side in the second direction; and a second restriction part which is protruded from a tip end side of the second arm part in a direction intersecting the second direction and is capable of abutting with the drive unit from the one side in the second direction.

7. The ice making device according to claim 6, wherein the mounting part comprises a support face which supports the drive unit from one side in a third direction intersecting the first direction and the second direction in a state that the connecting part is fitted to the fitted part, and the first corning-off prevention part is structured so that the first arm part is extended along the support face and the first restriction part is protruded from a tip end side of the first arm part toward the other side in the third direction.

8. The ice making device according to claim 7, wherein the fitted part comprises a first pawl which is protruded toward the other side in the third direction and a tip end side of the first pawl is bent to the one side in the second direction, and the drive unit comprises, as the connecting part, a first plate part wherein a plate thickness direction of the first plate part is directed in the third direction and which is protruded from one side in the first direction to the other side in the first direction and is fitted to an inner side of the first pawl.

9. The ice making device according to claim 1, wherein a moving direction of the drive unit when the connecting part is to be fitted to the fitted part is a same direction as a direction of a force which is generated against twisting of the ice tray and is applied from the ice tray to the drive unit.

10. An ice making device comprising:

an ice tray comprising water storage recessed parts which are disposed upward;

a drive unit structured to make the ice tray perform a reversing operation around an axial line extended in a first direction intersecting an upper and lower direction and perform a twisting operation interlocked with the reversing operation; and a frame on which the drive unit is mounted;

wherein the frame comprises in a mounting part for the drive unit:

a fitted part to which a connecting part of the drive unit is fitted when the drive unit has been moved from one side in a second direction intersecting the first direction to the other side in the second direction; and a first coming-off prevention part structured to prevent coming-off of the connecting part from the fitted part when the drive unit has been moved from the one side in the second direction to the other side in the second direction;

wherein the first coming-off prevention part comprises:

a first arm part which is extended from the one side in the second direction to the other side in the second direction; and a first restriction part which is protruded from a tip end side of the first arm part in a direction intersecting the second direction and is capable of abutting with the drive unit from the one side in the second direction, wherein the drive unit comprises a cam gear which is turned by a rotating force of a motor on an inner side of a case, the cam gear comprises an output shaft which is protruded from the case and is connected with the ice tray, the connecting part of the drive unit is formed so as to be protruded from the case in the first direction and fitted to the fitted part and is capable of abutting with the first restriction part of the first coming-off prevention part, wherein the frame comprises:

a first side plate part which is extended in the first direction on the other side in the second direction; and a second side plate part which is extended in the first direction on one side in the second direction so as to be parallel to the first side plate part, the mounting part for the drive unit is formed between the first side plate part and the second side plate part, the case is formed in a rectangular parallelepiped shape, the mounting part comprises a second coming-off prevention part which is provided at a position separated from the first coming-off prevention part in the first direction and is capable of abutting with the case from the one side in the second direction to prevent coming-off of the connecting part from the fitted part when the drive unit has been moved from the one side in the second direction to the other side, the second coming-off prevention part comprises:

a second arm part which is extended from the other side in the second direction to the one side in the second direction; and a second restriction part which is protruded from a tip end side of the second arm part in a direction intersecting the second direction and is capable of abutting with the case of the drive unit from the one side in the second direction, and the second restriction part is provided between the case and the second side plate part.

11. The ice making device according to claim 10, wherein the mounting part comprises a support face which supports the drive unit from one side in a third direction intersecting the first direction and the second direction in a state that the connecting part is fitted to the fitted part, the first coming-off prevention part is provided in the frame on the other side in the first direction with respect to an end plate of the case from which the output shaft is protruded, the first coming-off prevention part is structured so that the first arm part is extended along the support face and the first restriction part is protruded from a tip end side of the first arm part toward the other side in the third direction, and the connecting part is formed so as to be protruded from the end plate of the case to the other side in the first direction and is capable of abutting with the first restriction part.

12. The ice making device according to claim 11, wherein the fitted part comprises a first pawl which is protruded toward the other side in the third direction and a tip end side of the first pawl is bent to the one side in the second direction, and the drive unit comprises, as the connecting part, a first plate part wherein a plate thickness direction of the first plate part is directed in the third direction and which is fitted to one side in the third direction of the first pawl.

13. The ice making device according to claim 12, wherein the fitted part comprises a second pawl which is protruded toward the other side in the third direction and a tip end side of the second pawl is bent to the one side in the second direction at a position separated from the first pawl to the other side in the second direction, and the drive unit comprises, as the connecting part, a second plate part which is provided at a position separated from the first plate part to the other side in the second direction and is protruded from the end plate of the case to the other side in the first direction and is fitted to one side in the third direction of the second pawl.

14. The ice making device according to claim 10, wherein a moving direction of the drive unit when the connecting part is to be fitted to the fitted part is set in a reverse direction to a turning direction of the output shaft when ice pieces of the ice tray is separated.

* * * * *